US008765257B2

(12) United States Patent
Weedlun

(10) Patent No.: US 8,765,257 B2
(45) Date of Patent: Jul. 1, 2014

(54) HEAT ACTIVATED APPLIQUE WITH UPPER STRETCH FABRIC LAYER

(76) Inventor: Paul Weedlun, Ellicott City, MD (US)

( * ) Notice: Subject to any disclaimer, the term of this patent is extended or adjusted under 35 U.S.C. 154(b) by 693 days.

(21) Appl. No.: 12/387,718

(22) Filed: May 6, 2009

(65) Prior Publication Data

US 2009/0280290 A1 Nov. 12, 2009

Related U.S. Application Data

(60) Provisional application No. 61/126,655, filed on May 6, 2008.

(51) Int. Cl.

| | |
|---|---|
| ***B32B 3/06*** | (2006.01) |
| ***B32B 3/00*** | (2006.01) |
| ***B32B 7/12*** | (2006.01) |

(52) U.S. Cl.
USPC ..... 428/343; 428/102; 428/200; 428/172

(58) Field of Classification Search
USPC ..... 428/343, 102, 200, 172
See application file for complete search history.

(56) References Cited

U.S. PATENT DOCUMENTS

| | | | | |
|---|---|---|---|---|
| 3,657,060 | A * | 4/1972 | Haigh | 428/175 |
| 4,390,387 | A | 6/1983 | Mahn | |
| 5,009,943 | A | 4/1991 | Stahl | |
| 5,312,645 | A | 5/1994 | Dressler | |
| 5,411,783 | A | 5/1995 | Mahn, Jr. | |
| 5,413,841 | A | 5/1995 | Mahn, Sr. et al. | |
| 5,635,001 | A | 6/1997 | Mahn, Jr. | |
| 5,665,458 | A | 9/1997 | Mahn, Jr. | |
| 5,914,176 | A | 6/1999 | Myers | |
| 6,241,841 | B1 | 6/2001 | Mahn, Sr. et al. | |
| 6,265,053 | B1 | 7/2001 | Kronzer et al. | |
| 6,361,855 | B2 | 3/2002 | Mahn, Jr. et al. | |
| 6,703,086 | B2 | 3/2004 | Kronzer et al. | |
| 2003/0091799 | A1 | 5/2003 | Franke | |
| 2003/0134113 | A1 | 7/2003 | Franke | |
| 2004/0147187 | A1 * | 7/2004 | Rasor, Sr. | 442/85 |
| 2005/0279445 | A1 * | 12/2005 | Shemanski et al. | 156/166 |
| 2006/0230503 | A1 * | 10/2006 | Shterenberg et al. | 2/309 |
| 2008/0014819 | A1 * | 1/2008 | Suzuki et al. | 442/401 |
| 2009/0025123 | A1 * | 1/2009 | Weedlun et al. | 2/244 |

FOREIGN PATENT DOCUMENTS

WO WO2007103168 * 9/2007

* cited by examiner

*Primary Examiner* — Samir Shah
(74) *Attorney, Agent, or Firm* — Ober, Kaler, Grimes & Shriver; Royal W. Craig

(57) ABSTRACT

A heat activated applique for apparel and other textile products, and particularly those made out of stretch fabrics (typically knit or woven fabrics) comprised of synthetic or natural fiber yarns constructed with spandex fibers and yarns. The applique includes an upper stretchable fabric layer bonded to a substrate by a thermoplastic adhesive. The stretchable fabric layer is a knit or woven fabric with spandex and polyester or nylon threads, and the thermoplastic adhesive is a urethane-based thermoplastic adhesive with stretch and recovery characteristics. The applique can be layered to provide a three-dimensional characteristic, embossed or etched to provide a surface texture, and adorned with direct printing or sublimation dye. The applique may be easily heat-sealed to a garment or other textile.

22 Claims, 3 Drawing Sheets

HEAT ACTIVATED APPLIQUE WITH UPPER STRETCH FABRIC LAYER

CROSS-REFERENCE TO RELATED APPLICATIONS

This application derives priority from U.S. provisional patent application Ser. No. 61/126,655, entitled "Heat Activated Appliqué with Upper Stretch Fabric Layer" filed May 6, 2008, which provisional patent application is hereby incorporated by reference.

BACKGROUND OF THE INVENTION

1. Field of the Invention

The present invention relates to heat activated transfers and appliqués that are used to apply a variety of different indicia onto a variety of different substrates. The particular indicia can be used as a decorative element such as appliqué text, logo graphics or numbers for adhesive application directly onto garments, apparel, and accessories, for identification, decoration, trademarking or otherwise embellishing the final product.

2. Description of the Background

Fashion, "basic" and performance apparel, uniform, swimwear and intimate apparel and accessory manufacturers use various methods to apply decoration and identification to stretchable garments and textiles. Common technologies include silk-screening, screen-printing, sonic welding, direct embroidery and heat activated transfers as the primary methods for decorating and identification of these stretchable garments and textiles.

Silk-screening of logos or emblems, though commonly used, does not result in a product that withstands repeated stretching, and is a complex and time-consuming process. In addition, the designs created by silk-screening are flat, lack texture, and do not withstand repeated industrial or home laundering. These deficiencies are avoided by embroidery; consequently, many companies prefer embroidery as their primary method for applying decoration and identification over silk-screening.

Sonic welding is another method used to apply decoration and identification to garments and textiles. This process requires the creation of unique, expensive special dies for any design to be applied. The quick-change requirements associated with the performance apparel industry make this process slow and relatively expensive. Sonic welding allows texturing, but also requires chemical compounds that some companies find unacceptable, and that can result in a product that does not stand stretching or repeated home and industrial laundering. Indeed, this process typically is not used by the uniform industry for these reasons. Embroidery has instead become the primary method for applying decoration and identification in that industry.

Embroidery is typically performed by a machine that applies stitching of various colors and styles to fabric to create a design. Embroidered designs have a much greater aesthetic value, and stand repeated home and industrial launderings. However, this too is a complex, time-consuming process, and results in a decoration or identification that does not stretch with the substrate.

There have been a few attempts at providing an embroidered appearance without utilizing embroidery. U.S. Pat. No. 5,009,943 to Stahl discloses a method for producing a multicolored emblem that may be ironed-on to garments to provide an embroidered appearance. This method entails laminating a material blank, cutting the laminated material to a specific design, embroidering about the periphery of the cut design, laminating the assembly onto a second material blank, and coating the underside with a thermal adhesive layer. The emblem can then be heat-sealed to a garment. Despite the ability to give a realistic embroidered look, emblems produced using Stahls' method are relatively large, bulky and inflexible.

There are other transfer emblems that may be applied to various cloth surfaces without embroidery. For example, U.S. Pat. No. 5,635,001 to Mahn, Jr. issued Jun. 3, 1997 shows cloth transfers that include a cloth layer coated with a plastic layer which is, in turn, coated with a pressure sensitive adhesive layer.

U.S. Pat. No. 5,914,176 to Myers issued Jun. 22, 1999 shows a composite design for attachment to another fabric article, comprising an underlying layer of twill fabric on one side of which a design is printed and heat cured. The twill is cut into a desired shape so that the twill and the ink portion form the composite design. Methods of making and attaching the composite design are disclosed.

Though stitched embroidery is avoided, in both of the foregoing cases resulting product are not stretchable and are is inferior in durability to washing.

For these reasons, apparel manufacturers often use heat activated transfer and appliquémethods to apply decoration and identification to garments and textiles, particularly those garments and textiles subject to stretching. Apparel manufacturers tend to use thermoplastic transfers, flocked thermoplastic transfers, thermo-transfer films, thermo-transfer cellulosic nonwoven webs, or elastomer transfers.

Particularly when applying these to a substrate, there are a number of different critical criteria for a heat activated appliqué. The indicia or heat activated appliqué must not curl after being adhered. The feel of the heat activated appliqué, once applied to the substrate, must feel like a textile product which can offer a variety of characteristics but is differentiated from plastic films which have very smooth non-tactile surfaces unless mechanically created or altered. A fabric surface appliqué has superior durability through wash and dry cycles, and through other fabric care procedures inasmuch as the appliqué can be ironed which is not possible with plastic films.

An increasingly popular manner of marking sports jerseys is to apply a first numeral or letter and then apply a second numeral or letter of a smaller size directly upon the first numeral or letter, providing a three dimensional appearance. This requires two heat activated appliqués, one of which is bondable atop the other. To provide for ease of application and flexibility, it is preferable that the upper heat activated appliqué layer be bonded to the lower in advance of final application to the apparel, garment, bag or home furnishing. This greatly facilitates applying the appliqué upon the substrate of the product to be embellished.

A limitation of existing appliqués are the greater rigidity or stiffness of the appliqué as compared to the product to which they are being adhered. When applied, such appliqués can decrease the comfort to the wearer of an apparel garment and change the drape characteristics of the product making it less visually appealing.

Many apparel products which have been traditionally decorated with appliqués are being made of performance materials which can be lighter weight or have stretch materials used in their constructions. A thermally adhered appliqué made with stretch fabrics allows the stretch and drape characteristics of the apparel to be retained. A thermally applied appliqué made of stretch fabric could be applied to performance apparel such as swim suits, bicycle pants and compression garments to embellish these garments, which could not have otherwise been decorated with traditional appliqués.

U.S. Pat. No. 5,411,783 to Mahn, Jr. issued May 2, 1995 relates to a heat activated appliqué for providing in particular numbers and letters for sports jerseys and is comprised of an upper colored thermoplastic elastomer layer bonded to a cloth substrate by a thermoplastic adhesive. (U.S. Pat. No. 5,665,458 to Mahn, Jr. issued Sep. 9, 1997 is similar to the foregoing emphasizes kiss-cut lines through the heat activated adhesive layer and indicia-bearing layer, but not through the support layer, to separate indicia-bearing portions of said appliqué from waste portions.

U.S. Pat. No. 5,413,841 to Mahn, Sr., et al. issued May 9, 1995 relates to a heat activated transfer comprised of a lower thermoplastic adhesive layer, an upper transparent thermoset layer, and indicia formed by dye sublimation printing. (U.S. Pat. No. 6,241,841 to Mahn, Sr., et al. issued Jun. 5, 2001 is identical to '841 (originally a divisional of the application that went on to become Registration U.S. Pat. No. 5,413,841), and includes the counterpart method claims).

U.S. Pat. No. 5,312,645 to Dressler (Stahls) issued May 17, 1994 shows heat-applied athletic lettering formed by coating a layer of thermoplastic material (pigmented polyurethane) onto a transparent polyester plastic film.

U.S. Pat. No. 6,265,053 to Krozner et al. issued Jun. 24, 2001 relates to a printable material comprised of a flexible first layer (may be a film or cellulosic nonwoven web) and a second layer (which includes a nonwoven web). The layers are bonded either thermally or using an adhesive. All of the claims require a catalyst on the second layer (polyvinyl alcohol or polyoxyethylene) for increasing the viscosity of inkjet toner. (U.S. Pat. No. 6,703,086 to Krozner, et al. issued Mar. 9, 2004 is a divisional of the '053, but includes claims that do not require a viscosity promoter; instead, they require the first layer to have a basis weight of from about 20 to about 140 grams per square meter).

U.S. Pat. No. 4,390,387 to Mahn issued Jun. 28, 1983 relates to a flocked material having a first thermosetting adhesive layer and a second thermoplastic adhesive layer.

U.S. Pat. No. 6,361,855 to Mahn, Jr. et al. issued Mar. 26, 2002 relates to a heat activated transfer and method of transfer comprised of a laminate comprised of a pigmented polyurethane (or blown film) layer and a polyester adhesive layer.

United States Patent Applications 20030091799 and 20030134113 both by Franke filed Dec. 20, 2002 relate to a transfer comprised of a colored carrier sheet, an elastomer layer, a heat-activated thermoplastic polymeric glue layer.

While all of the transfers described in these patents and patent applications avoid the problems inherent in embroidery or other methods of producing identification or decoration marks, none of them provides the texture and appearance of fabric or an embroidered appliqué. Further, none of them is immune from cracking as a result of the long-term stretching inherent to being bonded to a flexible substrate. It would be greatly advantageous to provide a transfer appliqué that would provide the ease of thermoplastic transfers with the appearance of embroidery while flexing with a stretchable garment or other substrate.

SUMMARY OF THE INVENTION

It is, therefore, an object of the present invention to provide a novel heat-activated appliqué bearing text, numbers, logos and other indicia for the uniform and other industries that serves as an embroidery, thermo-transfer films, silk screen or sublimated printing replacement in giving a monogrammed appearance.

These and other objects are achieved by an application comprising an upper, stretchable fabric layer bonded to a substrate by a thermoplastic adhesive. The present invention is premised on the realization that a heat activated laminate formed from a stretch fabric upper layer and a heat activated adhesive lower layer provides an excellent heat activated appliqué. The heat activated appliqué does not curl and can be easily cut. Further, this appliqué can be easily bonded to itself and is shelf stable. In short, it meets all the major requirements for a heat activated appliqué. Thermoplastic film overcomes tendency of fabric to curl.

These heat activated appliqués of the present invention are particularly suitable for use in forming decorations for apparel, bags and home furnishings. Their soft tactile hand feel does not cause discomfort to the wearer. Because they are formed from a stretch fabric that can stretch and recover to their original shape, they stretch and exhibit memory. Further, these stretch fabrics require no additional lubricants, waxes or plasticizers which can migrate out and interfere with adhesion. Further, the heat activated appliqué does not bleed into the substrate or feather out, even after extremely prolonged application of elevated temperature and pressure.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a heat-activated appliqué with an upper stretch fabric layer. The appliqué may include a multicolor printed design appearance with or without simulated and/or textured embroidery stitching, and may be heat sealed to an article of clothing or clothing accessory. In each case the appliqué is well-suited for application to any fabric or leather substrate, including coarser non-woven fabrics such as felt and fleece ("substrate" being herein defined as any leather or fabric, whether woven fabric or non-woven fabric, or any other flexible material used for apparel, signage, banners, pennants or similar, and "non-woven" being herein defined as any fabric substrate produced by processes other than weaving). The suitability for a particular substrate depends on the heat-seal thermoplastic film used as well as the characteristics of the stretchable fabric layer, and as described below, various upper fabric layers are available for various substrates.

Figure 1:
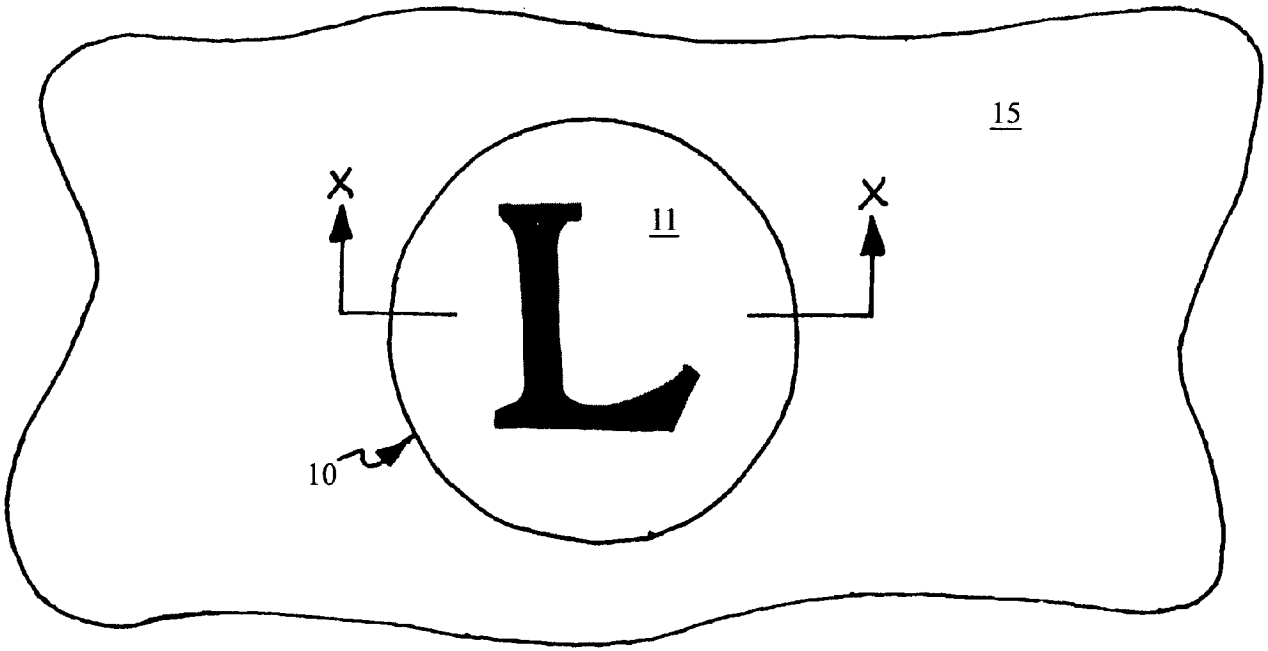
FIG. 1 is a top view of an appliqué emblem 10 according to the present invention as applied to apparel.
Figure 2:
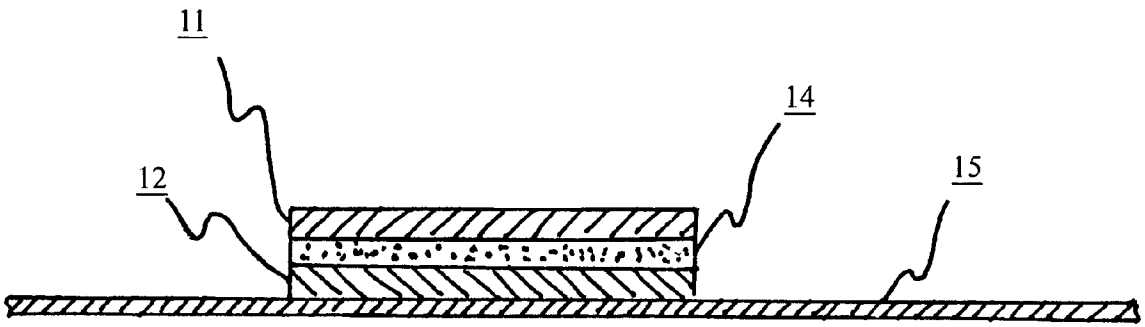
FIG. 2 is a cross-sectional view of an embodiment of the present invention taken at line xx of FIG. 1.

With combined reference to FIGS. 1 and 2, the heat activated appliqué 10 of the present invention includes a lower heat activated adhesive layer 12 and an upper stretch fabric layer 14 atop the lower heat activated adhesive layer 12. The heat activated adhesive layer 12 bonds the stretch fabric layer 14 to a substrate 15, which may be any fabric or leather substrate as defined above.

The stretch fabric layer 14 further comprises a knit or woven fabric incorporating at least 3% spandex thread in combination with other natural and/or synthetic fiber threads such as cotton or Nylon™, to provide a minimum stretch and recovery of 5%.

The spandex thread may be of the Lycra® type, which is a registered trademark of Invista. Spandex stretch fabrics possess at normal temperature ranges the characteristic of resilience and recovery from repeated extensions. Moreover, it can survive without degradation of performance at the elevated temperatures used to heat-activate the lower adhesive layer of the present invention, which is used to bond the appliqué to the desired products. The stretch fabric layer 14 material can be fabricated by the usual techniques of knitting or weaving as applied to conventional fabric constructions. One particular stretch fabric which is particularly suitable for use in the present invention is Style 22700, Bright Tecsheen, manufactured by Darlington Fabrics. This is a Nylon/Spandex-based stretch fabric.

An inked image 11 which may be a decorative image or shape including alpha-numeric characters, logos or images, is printed atop the stretch fabric layer 14.

The lower heat activated adhesive layer 12 may be any suitable thermoplastic adhesive and may be processed using standard plastic processing equipment. Particular thermoplastics including polyester, urethane, nylon, polyolefin, thermoplastic polybutadiene, ethylene vinyl acetate copolymer thermoplastic, thermoplastic PVC/nitrile rubber, thermoplastic fluorocarbon elastomer, thermoplastic chlorinated polyethylene elastomer, and thermoplastic styrene butadiene rubber. The thickness or mass of the second lower layer adhesive will also affect the bond of the appliqué to the base garment or product of the heat activated appliqué of the present invention. The film thickness of the adhesive will vary from about 3 to about 15 mils, and preferably from about 3 to 7 mils, with about 5 mils being preferred.

The lower heat activated adhesive layer 12 used in the present invention should have a melting temperature in excess of about 325 degrees Fahrenheit up to 400 degrees Fahrenheit or higher. This, of course, will vary widely depending upon the particular application and in particular the adhesive used. If a lower melting point adhesive is used, a stretch fabric with a lower melting point can also be employed.

The lower layer 12 is a compatible heat activated adhesive layer. Suitable thermoplastic adhesives for the present invention include urethane adhesives such as Bemis SEWFREE® 3405 urethane films produced by Bemis Associates Inc. or similar urethane films produced by Deerfield Urethanes Inc.

To form the heat activated appliqué 10 of the present invention, the lower thermoplastic adhesive layer 12 is simply laminated to the upper stretch fabric layer 14. The stretch fabric and film are simply passed together through a laminator at about 350 degrees Fahrenheit to form the heat activated appliqué 10 of the present invention. An alternative method for forming the laminate would be to use a heat-seal press to bond the stretch fabric and thermoplastic adhesive. The laminated composite can then be cut to provide the individual indicia, i.e., letter, numbers, logos and/or emblems. These can then be applied to a substrate by applying heat at about 350 degrees Fahrenheit and pressure of 20-50 PSI against the upper stretch fabric layer toward the substrate for between 5 and 45 seconds (preferably 30 seconds), causing the adhesive layer to soften, penetrate the substrate and bond the stretch fabric layer to the substrate.

Figure 3:
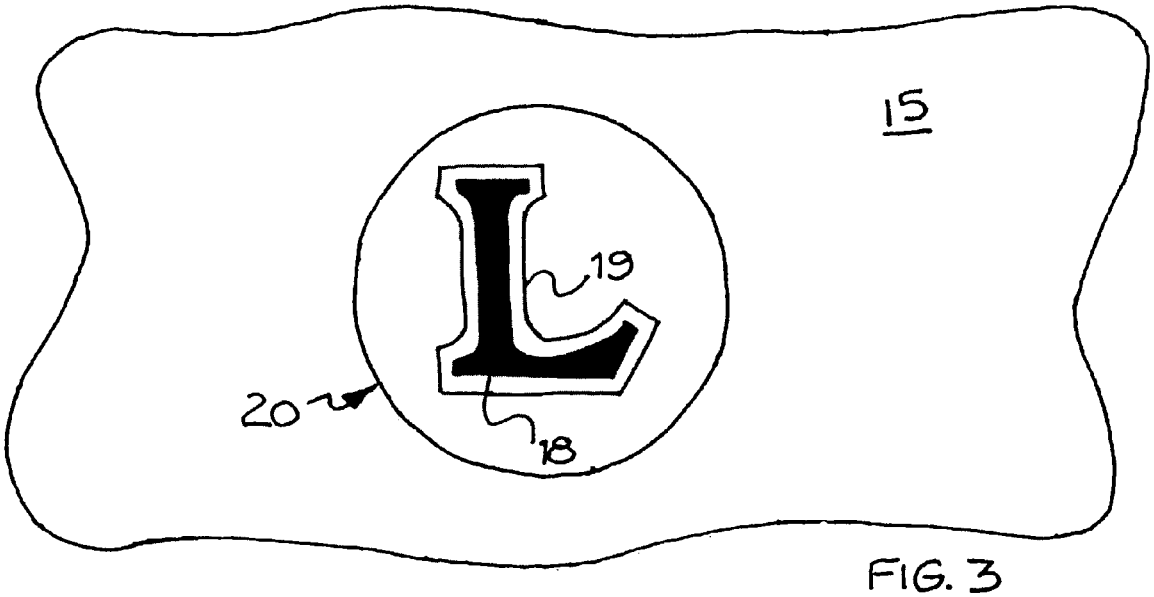
FIG. 3 is a top view of an alternate embodiment of the present invention.

With reference to FIG. 3, an alternate embodiment 20 of the present invention is depicted in which an initial letter appliqué 18 is applied to a second letter appliqué 19 having a slightly larger dimension than the first letter 18, both the first letter 18 and the second letter 19 are formed from the same constituents of top layer stretch fabrics with bottom layer thermoplastic films.

To form the indicia shown in FIG. 3, the first letter 18 is applied to the second letter 19 with heat and pressure sufficient to cause the thermoplastic layer on the bottom of 18 to bond to the stretch fabric layer of 19. Subsequently, the two parts are placed upon the garment and heat and pressure are applied sufficient to cause the lower thermoplastic adhesive layer of 19 to soften and subsequently bond to the garment.

Figure 4:
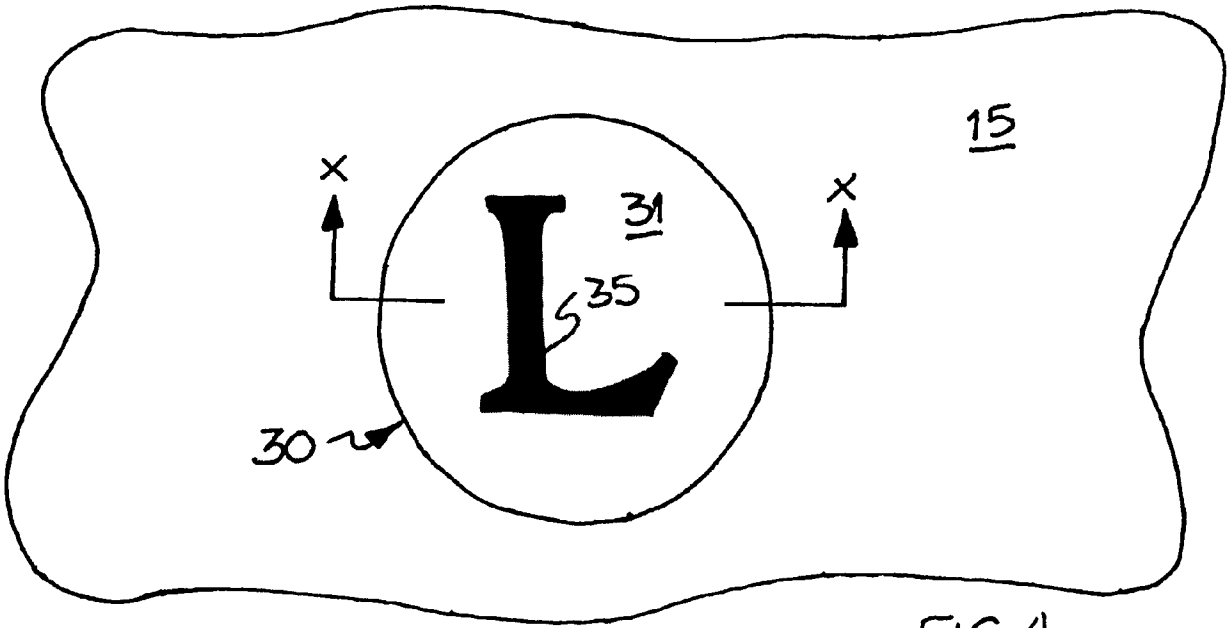
FIG. 4 is a top view of a second alternate embodiment of the present invention.
Figure 5:
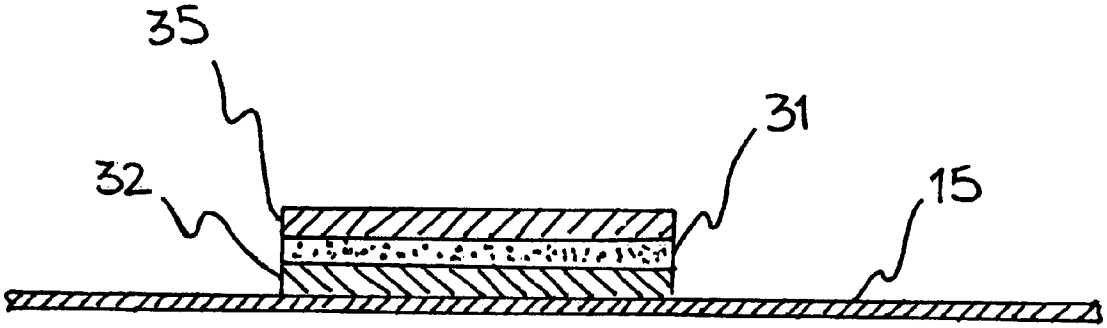
FIG. 5 is a cross-sectional view taken at line xx of the second alternate embodiment shown in FIG. 4.

An alternate embodiment 30 is shown in FIGS. 4 and 5. In this embodiment, the upper layer 31 is a stretch fabric layer. This is bonded to a lower thermoplastic layer 32, preferably a urethane adhesive layer, Both the film thicknesses and chemical compositions of these layers are the same as the embodiment shown in FIGS. 1 and 2. In this embodiment, however, the stretch fabric layer 31 is either white or colored and is marked in turn with indicia 35 which is either a direct digital dye print or a sublimation dye heat transferred into the surface of the stretch fabric layer.

In the appliqué 30, the surface layer of stretch fabric in this embodiment has an embossed surface which provides surface configuration to the appliqué. The appliqué shown in FIG. 4 has a plurality of embossed areas throughout its surface. However, any surface configuration can be employed depending on the structure of the heating iron. The embodiments shown in FIG. 1 and FIG. 3 can also be embossed in this manner if desired.

The indicia 35 can be heat transferred to the upper stretch fabric layer 31 either prior to bonding to the thermoplastic adhesive layer 32 subsequent to bonding to the thermoplastic adhesive layer and prior to being bonded to the substrate 15 or can be applied at the same time the appliqué 30 is heat bonded to the substrate. Likewise, the embossment or application of surface configuration can be made at any of these times. This provides a very unique heat activated appliqué which has significant dimensional configuration not normally present in heat activated appliqués.

The use of the stretch fabric provides an extreme flexibility in producing and applying heat activated appliqués. Due to the fabric structure options of the stretch fabric layer, the surface configuration can be fairly dramatic. Further, marking the stretch fabric with the sublimation dye or direct digital printing provides an exceptionally durable and aesthetically appealing appliqué.

Thus, the present invention provides a variety of different means to provide indicia onto particular substrates. One particular advantage of the present invention is that even when the individual applying the appliqué to the substrate applies the heat and pressure for an excessively long period of time, the stretch fabric tends to retain its shape and configuration and does not bleed into the cloth. Even when the duration of the heat and pressure is twice the desired duration, the indicia do not bleed into the cloth surface. This is important, not only in that it prevents the indicia from being ruined, but it also prevents the substrate from being ruined. Using a stretch fabric also provides excellent hand feel, stretch and recovery. This is accomplished without additives such as waxes or plasticizers which can interfere with adhesion. These combine to provide an excellent appliqué.

I claim:

1. A heat activated applique comprising a stretch fabric layer providing indicia, said stretch fabric layer further comprising a woven or knit fabric formed of at least 3% spandex thread woven or knit with other fiber threads to provide at least a 5% stretch and recovery characteristic, said stretch fabric layer having a first surface bonded to a heat activated adhesive layer selected from the group consisting of thermoplastic adhesives and heat activated thermosettable adhesives, wherein said applique may be thermally-bonded to a stretchable fabric substrate by said heat activated adhesive layer.

2. The heat activated applique claimed in claim 1 wherein said stretch fabric layer comprises a woven synthetic fiber and spandex fiber blend.

3. The heat activated applique claimed in claim 2 wherein said stretch fabric layer has a minimum stretch and recovery of 5%.

4. The heat activated applique claimed in claim 1 wherein said thermoplastic adhesives are thermoplastic polyurethane adhesives.

5. The heat activated applique claimed in claim 4 wherein said adhesive is a thermoplastic urethane adhesive.

6. The heat activated applique claimed in claim 1 having a sublimation dye heat transferred into a second surface of said stretch fabric layer.

7. The heat activated applique claimed in claim 6 wherein said stretch fabric layer is embossed.

8. The heat activated applique in claim 1 wherein said indicia comprises a direct digital print onto said stretch fabric layer.

9. The heat activated applique claimed in claim 1 where said stretch fabric layer is embroidered.

10. The heat activated applique claimed in claim 1 where said substrate is leather.

11. The heat activated applique claimed in claim 1 where said substrate is a non-woven fabric.

12. A heat activated applique comprising a stretch fabric layer providing indicia, said stretch fabric layer further comprising a woven or knit fabric formed of at least 3% spandex thread woven or knit with other fiber threads to provide at least a 5% stretch and recovery characteristic, said stretch fabric layer having a first surface bonded to a heat activated adhesive layer selected from the group consisting of thermoplastic adhesives and heat activated thermosettable adhesives wherein said applique is bonded to a substrate by said heat activated adhesive layer, said fabric layer further comprising a first layer of a lesser surface area than a second layer the two layers comprising a decorative image or shape including alpha-numeric characters, logos or images, wherein said first layer is bonded to a top surface of said second layer.

13. The heat activated applique claimed in claim 12 wherein said stretch fabric layer comprises a woven or knit synthetic fiber and spandex fiber blend.

14. The heat activated applique claimed in claim 13 wherein said stretch fabric layer has a minimum stretch and recovery of 5%.

15. The heat activated applique claimed in claim 12 wherein said thermoplastic adhesives are thermoplastic polyesters, thermoplastic polyurethane adhesives, thermoplastic nylon adhesives or blends thereof.

16. The heat activated applique claimed in claim 15 wherein said adhesive is a thermoplastic urethane adhesive.

17. The heat activated applique claimed in claim 12 having a sublimation dye heat transferred into a second surface of said stretch fabric layer.

18. The heat activated applique claimed in claim 17 wherein said stretch fabric layer is embossed.

19. The heat activated applique in claim 12 wherein said indicia comprises a direct digital print onto said stretch fabric layer.

20. The heat activated applique claimed in claim 12 where said stretch fabric layer is embroidered.

21. The heat activated applique claimed in claim 12 where said substrate is leather.

22. The heat activated applique claimed in claim 12 where said substrate is a non-woven fabric.

* * * * *